United States Patent [19]

Bonaparte

[11] 4,344,489

[45] Aug. 17, 1982

[54] AERIAL FOREST FIRE EXTINGUISHING DEVICE

[76] Inventor: Al Bonaparte, 180 Luckie St., Atlanta, Ga. 30303

[21] Appl. No.: 190,013

[22] Filed: Sep. 22, 1980

[51] Int. Cl.[3] ..... A62C 3/02

[52] U.S. Cl. ..... 169/70; 102/383

[58] Field of Search ..... 169/53, 54, 62, 52, 169/72, 36, 70; 102/383, 364, 382, 334

[56] References Cited

U.S. PATENT DOCUMENTS

| | | | |
|---|---|---|---|
| 1,177,414 | 3/1916 | Howell | 102/383 |
| 1,300,333 | 4/1919 | Berry | 102/383 |
| 2,098,627 | 11/1937 | Jeanis | 102/383 |
| 2,703,527 | 3/1955 | Hansen | 169/53 |
| 2,779,421 | 1/1957 | Rust | 169/53 |

*Primary Examiner*—Robert J. Spar
*Assistant Examiner*—Kenneth Noland
*Attorney, Agent, or Firm*—Newton, Hopkins & Ormsby

[57] ABSTRACT

A forest fire extinguishing device comprising a projectile filled with an inert gas under pressure which is dropped into a fire and automatically disperses the gas. When the device impacts the ground, a plurality of ports are simultaneously opened, allowing the fire extinguishing material to be expelled over a prescribed area.

2 Claims, 3 Drawing Figures

AERIAL FOREST FIRE EXTINGUISHING DEVICE

BACKGROUND OF THE INVENTION

1. Field of the Invention

This invention relates to fire fighting equipment and, more particularly, to an aerial fire extinguishing device.

2. Description of the Prior Art

It is common for fire extinguishing material to be dispersed from airplanes or helicopters onto forest fires, or other types of conflagration, particularly where fire fighters cannot reach the site on the ground. In some instances, the material is sprayed onto the fire from the plane and, in other cases, bombs or other projectiles filled with fire quenching compounds are dropped directly into the fire, the device distributing its contents upon impact with the ground.

Some of the problems with the prior art aerial extinguishers include the fact that they are very complicated and bulky and do not insure that the fire extinguishing material can be adequately dispersed. That is particularly true of the type of aerial bomb that is to release its contents above the fire when the downward flight of the bomb is retarded.

BRIEF SUMMARY OF THE INVENTION

The above disadvantages of the prior art are overcome by the present invention which comprises a fire extinguishing bomb that disperses its contents upon impact with the ground. The device includes an elongated hollow housing which is substantially cylindrical in shape and which contains a supply of pressurized inert gas, such as carbon dioxide.

A shaft longitudinally extends through the housing and projects through its forward end, terminating in a weighted, ground piercing point. A brace member radially extends from the shaft adjacent the point. A plurality of ports are provided along the length of the housing, each port having a hinged door which is connected by linkage means to the shaft. The ports are normally kept in a closed position by means of the doors.

The device is dropped from a helicopter or airplane over a fire. The shaft is prevented from penetrating the ground more than a prescribed depth by the brace member, thereby maintaining the housing in an upright attitude upon impact.

The upward thrust of the shaft upon the impact automatically and simultaneously opens the ports through the linkage means so that the contents of the housing can be directed upon the flames.

It is, therefore, a primary object of the present invention to provide an aerial device which will automatically disperse fire extinguishing material upon impact with the ground.

Another object of the present invention is to provide a reliable and accurate device for delivering fire extinguishing material to any desired location in or adjacent to a fire.

DETAILED DESCRIPTION OF THE EMBODIMENT

Figure 1:
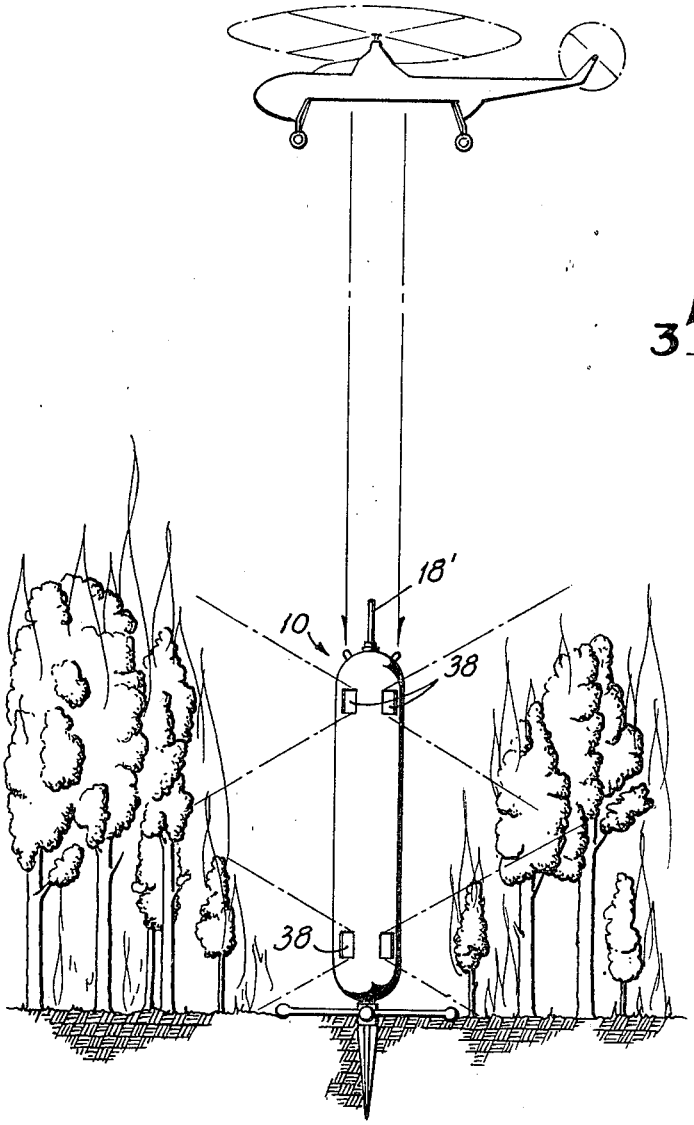
FIG. 1 is a schematic representation of the device of the present invention in operation.
Figure 3:
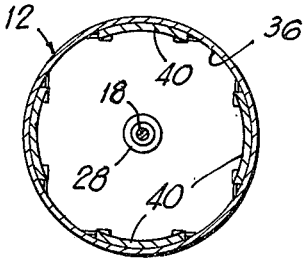
FIG. 3 is a view taken along line 3—3 in FIG. 2.

With reference to the figures of the drawing, the numeral 10 denotes generally the present invention and includes an elongated, hollow, cigar-shaped housing 12. The housing 12, as well as all of the other elements of the invention 10, may be constructed of steel. The housing includes a curved bottom 14 and a curved top 16.

Longitudinally extending through the center of housing 12 is a shaft 18, the forward end of which projects through the bottom 14 and terminates in a weighted, ground piercing point 20 which is of a frusto-conical shape in cross-section. Radially extending from the shaft 18 above the point 20 is a means for preventing the penetration of the device 10 into the ground beyond a pre-selected level and includes a circular element 22 from which project equally dimensioned rods 24 which terminate in bulbous members 26.

The shaft 18 slidably extends through the housing 12 by means of O-ring seals 28 located in the top 16 and bottom 14 of the housing 12. The seals 28 are pressure resistant.

Figure 2:
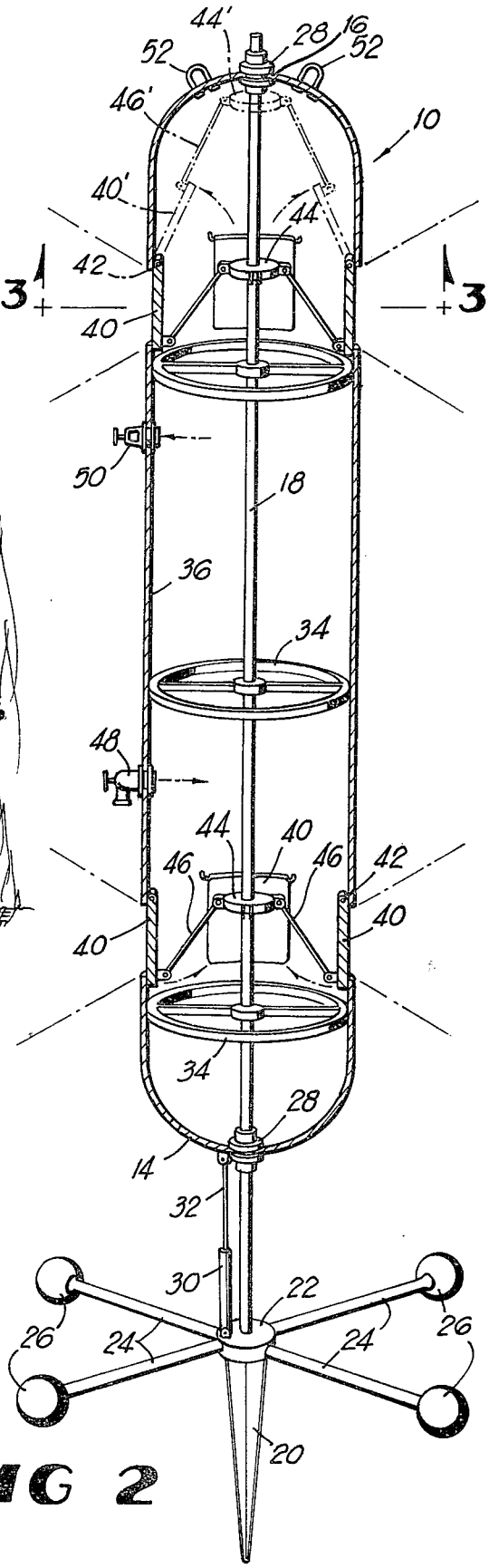
FIG. 2 is a perspective view of the present invention with the housing shown in cross-section.

Normally, the shaft 18 is in the extended position as shown in FIG. 2. To maintain the shaft 18 in that attitude prior to impact with the ground, an air cylinder 30 is connected to the top of the circular element 22 and has a piston 32 extending therefrom which is secured to the bottom 14.

A series of radially extending rings 34 are spaced along the length of shaft 18 within housing 12 and are connected to the interior wall 36 of housing 12 about their outer peripheries to provide a skeleton or brace for housing 12. A plurality of rectangular-shaped discharge ports 38 are provided through housing 12. In the illustrated embodiment, four ports 38 are equally spaced adjacent bottom 14 and an additional four ports 38 are located adjacent top 16. The ports 38 are normally maintained in a closed position by means of arcuate-shaped doors 40 which are pivotally secured about their upper ends to the interior wall 36 by means of a hinge 42.

Linkage means is provided for automatically opening the doors 40 upon impact of the device 10 with the ground and includes a circular mounting block 44 which is secured onto shaft 18, one of the blocks 44 being for each of the upper and lower sets of doors 40. A rod 46 is pivotally connected at one of its ends to a mounting block 44 and at its other end to the bottom of the door 40.

A charging nozzle 48 is provided on the exterior of housing 12 and which is in communication with the interior of the device 10 so that an inert gas under pressure may be introduced into the housing 12. A relief valve 50 is also located on the housing 12 to vent to the atmosphere excess pressure from the gas within the device 10.

A pair of U-shaped elements 52 are bolted to the exterior of the top 16 of the housing 12 to provide a means of transporting the device 10 by helicopter or airplane. Other suitable transport means may be provided on the device 10.

In operation, the interior of the housing 12 is filled with the pressurized gas through changing nozzle 48, the shaft 18 being in the position as seen in FIG. 2 so that the ports 38 are closed by doors 40. When the charging step is finished, the device 10 may be loaded onto any suitable aerial carrier and flown to the fire site.

When the device 10 is dropped onto the fire, it will fall with its piercing point 20 being maintained downwardly toward the ground due to the weight at bottom or forward area of the device 10.

When the point 20 strikes the earth, it will become imbedded in the ground along its length, further penetration of the device 10 into the ground being prevented by the action of the bulbous members 26 and rods 24 engaging the grounded surface which also maintain the device 10 in an erect attitude. The force of the impact will cause the shaft 18 to be pushed upwardly through the housing 12 until it assumes the position 18' as seen in FIG. 1. The upward thrust of shaft 18 will also make the rods 46 to move to the position as shown in phantom lines in FIG. 2 as 46', causing all of the doors 40 to pivot upwardly about hinge 42 to position 40'. That allows the pressurized gas to be radially dispersed through ports 38 onto the fire.

What it claim is:

1. An aerial forest fire extinguishing device which disperses its contents on impact with the ground, comprising: an elongated, hollow body having an interior surface and having a plurality of ports therethrough, a bottom and an opposed end and capable of storing an inert gas under pressure; a shaft longitudinally extending through said body and having opposed ends which are external of said body, said shaft being slideably received through said body; a point capable of penetrating the ground and formed at the termination of the end of said shaft adjacent said bottom; means for preventing the penetration of said body into the ground upon said impact; closure means for said ports which are moveable between a closed position and an open position; means for maintaining said closure means in said closed position prior to said impact and said shaft is coupled to the closure means so that as the point impacts with the ground the shaft is moved upwardly causing the closure means to move to the open position, and a plurality of rings which are radially spaced along said shaft within said body and which have outer peripheries which are secured to said interior surface to provide an internal brace for said device, said shaft being slideable through the center of said rings.

2. An aerial forest fire extinguishing device which disperses its contents on impact with the ground, comprising: an elongated, hollow body having an interior surface and having a plurality of ports therethrough, a bottom and an opposed end and capable of storing an inert gas under pressure; a shaft longitudinally extending through said body and having opposed ends which are external of said body, said shaft being slideably received through said body; a point capable of penetrating the ground and formed at the termination of the end of said shaft adjacent said bottom; means for preventing the penetration of said body into the ground upon said impact; closure means for said ports which are moveable between a closed position and an open position; means for maintaining said closure means in said closed position prior to said impact, said closure means including doors of sufficient dimension to overlie each of said ports and hinge means connecting said doors to said shaft so that as said point impacts the ground, said shaft is moved upwardly causing said doors to simultaneously move to said open position thereby dispersing said contents and wherein said maintaining means includes a cylinder connected to said preventing means and a piston moveable within said cylinder between an extended position and a retracted position and having an exposed end which is secured to said bottom, said piston being in said extended position prior to said impact so that said shaft extends from said bottom of said shaft to keep said doors in said closed position.

* * * * *